United States Patent [19]

Nidelkoff

[11] 4,115,936

[45] Sep. 26, 1978

[54] CHANGEABLE CHARACTER SIGN STRUCTURE

[75] Inventor: James G. Nidelkoff, White Bear Lake, Minn.

[73] Assignee: Minnesota Mining and Manufacturing Company, St. Paul, Minn.

[21] Appl. No.: 756,258

[22] Filed: Jan. 3, 1977

[51] Int. Cl.[2] ..... G09F 11/00

[52] U.S. Cl. ..... 40/449; 116/114 K

[58] Field of Search ..... 40/28 C, 52, 62

[56] References Cited

U.S. PATENT DOCUMENTS

| | | | |
|---|---|---|---|
| 1,101,023 | 7/1916 | Naylor | 40/28 C |
| 1,357,457 | 11/1920 | Jorgensen | 40/28 C |
| 1,679,520 | 8/1928 | Giroux | 40/28 C |
| 3,365,824 | 1/1968 | Winrow | 40/28 C |

*Primary Examiner*—Louis G. Mancene
*Assistant Examiner*—Wenceslao J. Contreras
*Attorney, Agent, or Firm*—Cruzan Alexander; Donald M. Sell; Robert W. Burns

[57] ABSTRACT

Sign having self-storing characters which are quickly changeable. The face of the sign has a patterned array of openings juxtaposed against a contrasting background. The background may be supplied by color contrast and/or by illumination. Shutters are mounted for sliding or pivotal movement for selectively closing the openings so that the remaining exposed background areas define visual information such as symbols or characters. Alternatively, the shutters may be rotatably mounted in the openings and have opposite sides which, respectively, contrast with and match the sign face color.

2 Claims, 7 Drawing Figures

CHANGEABLE CHARACTER SIGN STRUCTURE

BACKGROUND OF THE INVENTION

1. Field of the Invention

This invention relates to sign structures having changeable characters and, more particularly, to an improved sign structure having self-storing characters which may be quickly changed.

2. Description of the Prior Art

Signs having mechanically changeable characters are well known. Typically, such signs utilize discrete removable numbers and letters which are temporarily mounted to a sign face. The letters and numbers can be mounted on tracks or otherwise secured to the sign face. Applications include theater marquees, gasoline price signs, and billboards.

One disadvantage of the prior art signs is that the characters must be replaced to change the display. For track-mounted characters, this can involve removing the outermost characters to permit sliding the inner characters off the track. Also, for elevated signs, changing the display can be a time-consuming and hazardous undertaking.

It is highly desirable to have a sign of economical construction, which utilizes self-storing, quickly changeable characters, is vandal resistant, and is easily adaptable for internal illumination, or back lighting.

SUMMARY OF THE INVENTION

The present invention provides a sign structure having quickly changeable, self-storing characters. The face of the sign structure is of a predetermined color and has a patterned array of openings. Shutters are mounted on the sign face, on to an opening, for sliding or revolving movement between first and second positions such that, with a shutter in the first or second position, the associated opening is filled with color which is, respectively, the predetermined color or a contrasting color. Means is provided for securing the shutters in the first and second positons.

BRIEF DESCRIPTION OF THE DRAWING

The drawing will be more fully described in reference to the accompanying drawing wherein.

DETAILED DESCRIPTION OF THE PREFERRED EMBODIMENT

Figure 1:
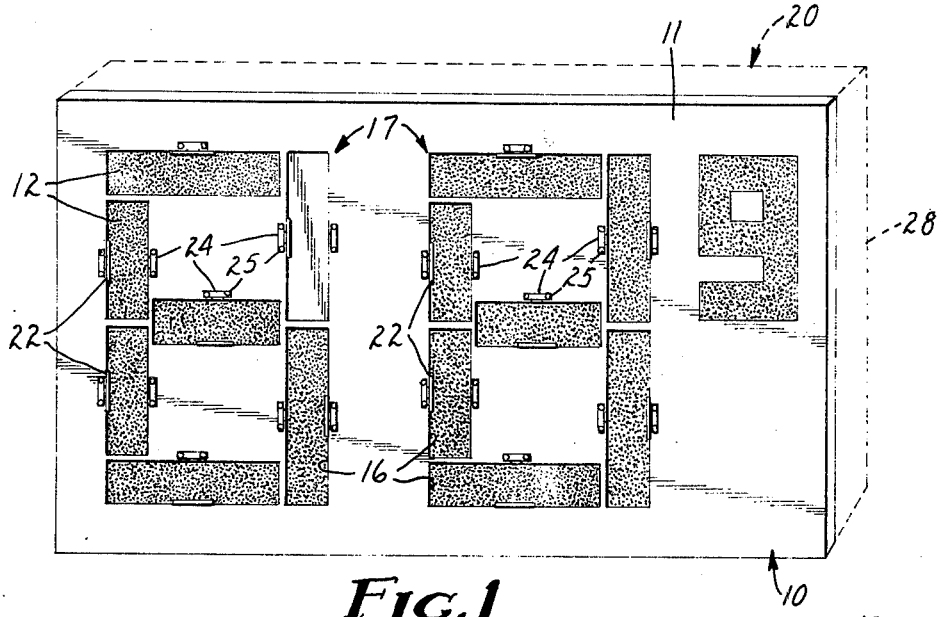
FIG. 1 is a perspective view of a sign, constrcuted according to the present invention, having quickly changeable, readily readable characters.
Figure 2:
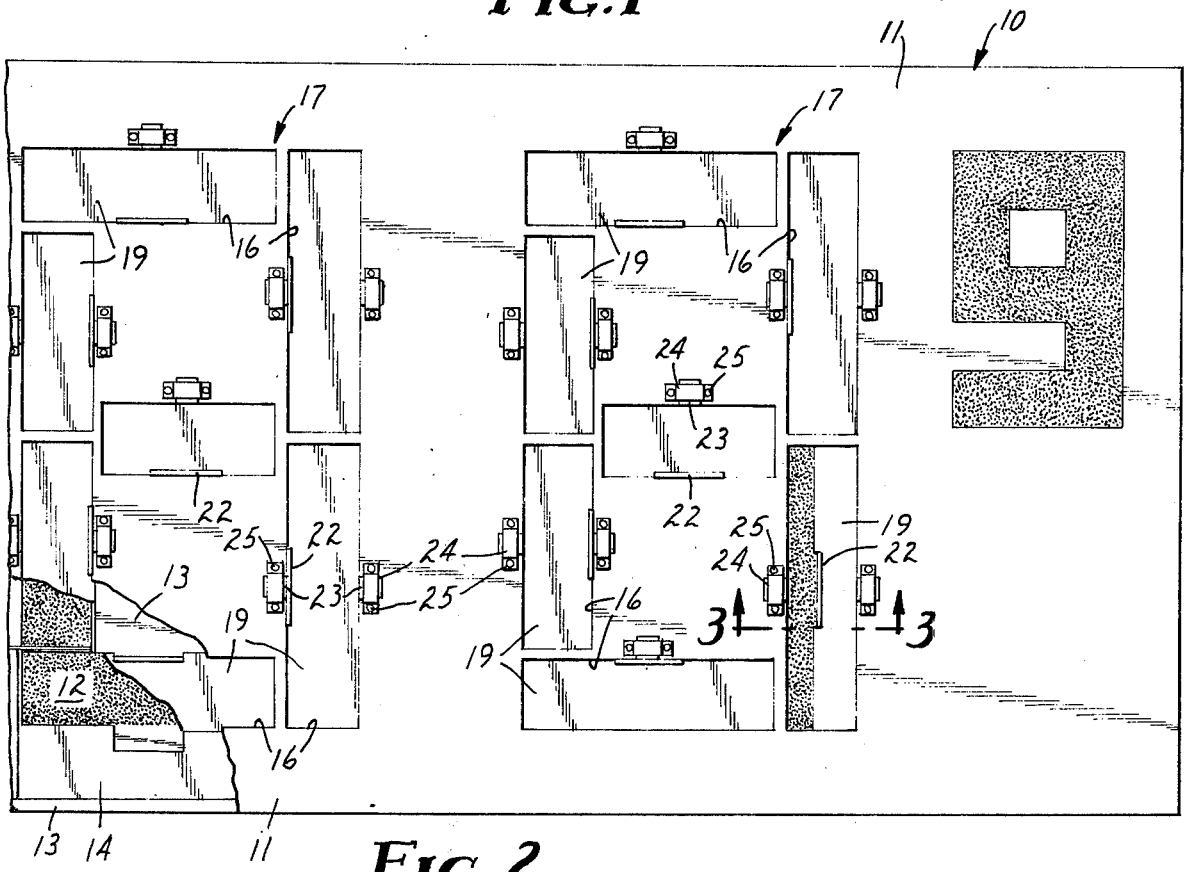
FIG. 2 is a front elevational view of a sign face constructed according to the invention with a portion broken away to show details of the sliding shutter construction.

The present invention provides a sign structure having characters which may be quickly changed. The characters are self-storing in that changes do not require physical attachment or removal of the characters. Referring to FIG. 2, there is illustrated a sign face structure 10 constructed according to the present invention. The sign face structure 10 may itself be used as a sign or may be affixed to or incorporated into other sign structures. For example, as shown in FIG. 1, the structure 10 comprises the face of an enclosed sign 20 which is used for advertising gasoline prices.

Referring again to FIG. 2, in one embodiment the sign face structure 10 comprises an apertured front plate 11, a visually contrasting back plate 12, and intermediate plates 13 and 14. These components may be held together by rivets, adhesive or other means.

Front plate 11 of the sign face 10 has a plurality of aperatures or openings 16—16 that are the basis of the information conveyed by the sign face. The openings 16—16 are rectangular and form the segments of seven-segment matrices 17—17, each of which is capable of forming the number 0 to 9.

Figure 3:
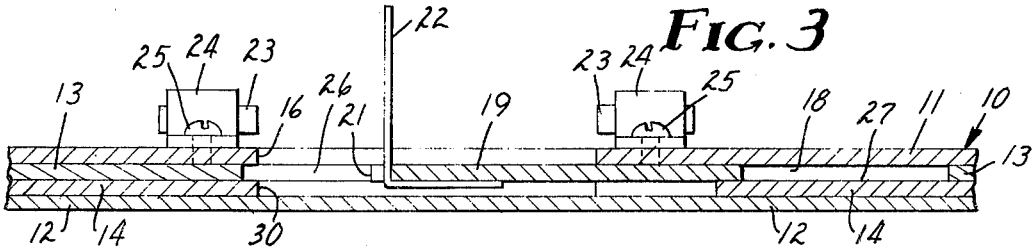
FIG. 3 is a sectional view of a portion of the sign face structure of FIG. 2, taken along lines 3—3.

Referring to FIGS. 2 and 3, each intermediate plate 13 has an opening 18 which defines a track for a shutter plate 19. The shutters 19—19 are retained for sliding movement along their associated tracks 18—18 by the front plate 11 and intermediate plate 14. The length of each track opening 18 in the direction of sliding movement (left to right and vice versa in FIG. 3) is approximately twice the corresponding dimension of the associated segment opening 16. Each track 18 may be considered to comprise two portions relative to the associated segment opening 16: a first, forward portion 26 (FIG. 3) which is below and aligned with the segment opening 16; and a second, rear portion 27 (FIG. 3) which is offset from the segment opening.

Each shutter 19 is of sufficient size to span or close its associated segment opening 16. Thus, the shutter 19 may be moved along the track opening 18 between a first, forward position (corresponding to forward portion 26 of the track) closing the segment opening 16 and a second, retracted position (corresponding to rear portion 27 of the track). In the retracted or open position, substantially all of the shutter 19 except a leading edge 21 (FIG. 3) is removed from the segment opening 16, thereby revealing the visually contrasting back plate 12.

A flange or handle 22 is attached to (or formed integrally with) the leading edge 21 of each shutter to permit manual opening and closing of the shutter. As shown in FIG. 3, the handle 22 is L-shaped and affixed to the lower side of its shutter 19. A slot 30 is formed in the plate 14 to permit passage of the handle 22 during movement of the shutter 19. Preferably, the handle 22 is also utilized as part of a latching device for holding the shutter in the closed and/or the open position. In a preferred embodiment, the handle 22 is formed of magnetic material or a magnet is affixed to the handle. The latching device is completed by magnet(s) 23—23, each of which is mounted to the sign face 10 by a bracket 24 which is attached to the front plate 11 by screws 25—25. The magnets 23—23 are used to maintain the handle in positions corresponding to the open and closed positions of the shutter.

The shutters 19—19 associated with the vertically-oriented ones of the segments 16—16 forming the sides of each number matrix 17 are designed to move in horizontal directions. As shown most clearly in FIG. 3 and 3, magnets 23—23 are utilized on opposite sides of the vertically-oriented segments (at the ends of the horizontal path of travel of the handle 22) to retain the shutters in the open and closed positions. Typically, those shutters used with the horizontally-oriented segments of each number matrix 17 have a vertical path of movement. These horizontally-oriented shutters are retained in the lower positions (typically, the closed position) by gravity and thus require magnets on only the upper side of the segment.

The shutters 19—19 may be selectively opened and closed to define any number from 0 to 9. Any number of matrices 17—17 may be used, with or without other indicia, in accordance with the type of information to be displayed. For example, the exemplary sign face structure 10 shown in FIG. 1 is constructed in accordance with the convention used for most service station gas price signs. The structure 10 has at least two number matrices 17—17 and has the fixed number "9" for indicating the cost per gallon of gasoline. The price displayed in FIG. 1 is 68.9¢. The sign display is easily changed as the price of gasoline changes. Of course, other combinations of numbers and combinations of numbers with other, fixed characters will be readily devised by those skilled in the art.

As mentioned previously, at least the portions of the front surface of the back plate 12 that are aligned with the segment openings 16—16 are of a color that contrasts with the color of the face of the front plate 11 and the front face of the shutters 19—19. This enhances the visibility of the sign face information display. To illustrate, the back plate may be white or orange, while the shutters and front plate are a dark gray or black. Alternatively, the front plate 11 and back plate 12 may be of the same or similar color and the characters may be supplied by the color contrast of the shutters. Also, the sign face structure 10 may be illuminated or backlighted. As an example, in the sign structure 20 of FIG. 1, the sign face 10 encloses a sign box 28 which may contain lights for illuminating the segment openings 16—16 via a translucent or transparent back plate 12.

Figure 4:
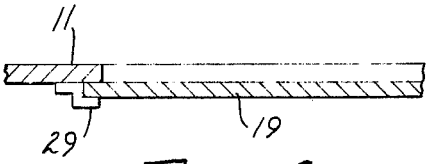
FIG. 4 is a sectional view of a portion of the sign of FIG. 1, taken along lines 4—4 of FIG. 1, showing an alternative arrangement for slidably mounting the shutters.

An alternative arrangement for slidably mounting the shutters 19—19 is shown in FIG. 4. Here, each shutter is supported at its opposite sides by brackets 29—29 (only one side and one bracket 29 are shown in FIG. 4), which mount the shutter for sliding movement perpendicular to the plane of the drawing. For the matrices 17—17 of rectangular openings 16—16 illustrated in FIG. 1, the brackets 29—29 are mounted at the short sides of the openings 16—16 to permit reciprocating movement of the shutters 19—19 in a direction parallel to the short side and perpendicular to the length of the openings and shutters. It will be noted that the use of the brackets 29—29 eliminates the need for intermediate plates 13 and 14 (shown in FIG. 3). Of course, with the elimination of the intermediate plates 13 and 14, it is desirable to use means, such as spacers (not shown), to provide adequate separation for movement of the shutters 19—19 between the front plate 11 and the back plate 12.

Figure 6:
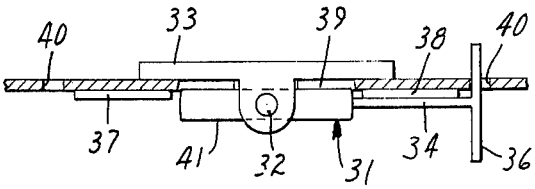
FIG. 6 is a sectional view of the rotatable shutter of FIG. 5, taken along the lines 6—6.
Figure 5:
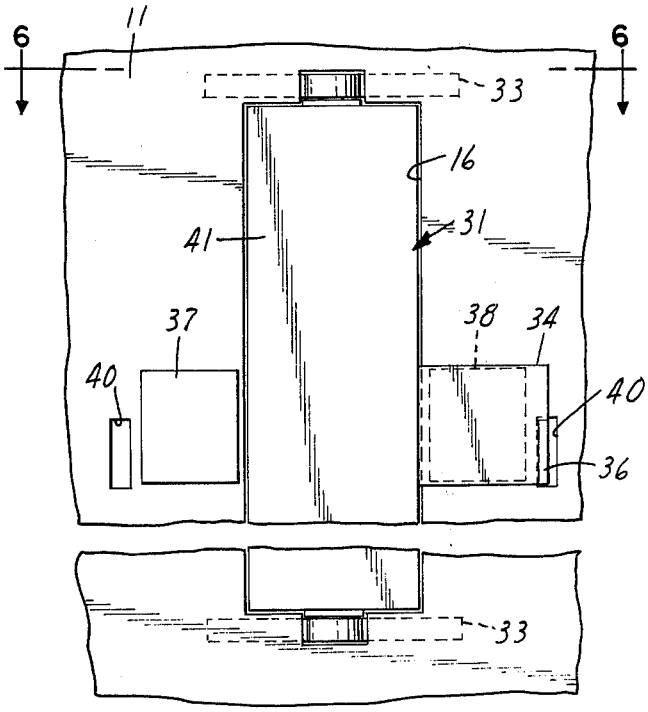
FIG. 5 is a partial elevational view with some parts broken away of an alternative embodiment of the invention, a rotatable shutter embodiment.

An alternative, rotatable shutter arrangement is shown in FIG. 5. Here, a shutter plate 31 has pins 32—32 (see FIG. 6: one pin 32 is shown) which are journaled within mounting blocks 33—33 located at opposite ends of the shutter opening 16. A handle 34 of magnetizable material is integrally formed with the shutter plate 31 (see FIGS. 5 and 6) and is used to rotate the shutter plate one-half revolution in either the clockwise or the counter-clockwise direction. To facilitate handling, a flange 36 is attached to the outer end of the handle 34, and extends transversely to either side of the handle, as shown in FIG. 6. Magnets 37 and 38 are affixed to the front plate 11 for retaining the handle in the two positions, hereafter designated the first and second positions, which correspond to the ends of the half-revolution path of travel of the shutter 31. Openings 40—40 are formed in the front plate 11 at either side of the openings 16 for receiving the handle flange 36 to permit a full half-revolution of travel and to permit the handle to lie flush against the magnets 37 and 38.

Referring to FIG. 6, opposite surfaces of the shutter 31 may be of two different colors so that one color is displayed when the handle is in the first or leftward position retained against magnet 37, and the second color is shown when the handle is in the second or rightward position retained against magnet 38. For example, top half 39 of the shutter 31 may be the same color as the visible surface of the front plate 11; bottom half 41 may be a contrasting color. Thus, and assuming the lower surface of front plate 11 in FIG. 6 is the visible surface (face) in FIG. 1, with the handle 34 in the first or leftward position, top half 39 would be visible and it is difficult to detect the presence of the segment opening 16 and the shutter 31.

However, with the handle rotated to the second or rightward position, which is illustrated in FIG. 6, the contrasting lower half 41 of the shutter is then to the front (visible surface) and the rectangular shutter opening 16 is clearly delineated by the contrasting color. It should be noted that the use of revolving shutter 31 makes it unnecessary to coordinate the color of the back plate 12 with the shutter or the front plate, or even to use the back plate.

Those skilled in the art will appreciate that other configurations which have opposite surface portions may be used for the revolving shutter 31. For example, a cylinder having a circular or polygonal cross-section may be used.

The sign face structure 10 provides several features that are desirable in a price or information changer. As explained, the characters and, thus, the information displayed can be quickly changed. The characters are self-storing in that they can be changed by rearrangement of elements contained within the sign face, rather than by attachment and removal of characters. The sign face structure is simple and is relatively inexpensive to construct. It leads itself to sturdy, vandal resistant construction. As described previously, the sign face structure can be incorporated into an internally lighted or backlighted sign structure. When incorporated in an elevated sign, a pole can be used to change the characters from the ground. Also, the Wagner "mechanical hand" is available for changeable copy boards up to 18 feet in height. The Wagner mechanical hand is available from 3M National Advertising Company, 6850 South Harlen Avenue, Bedford Park, Argo, Illinois 60501.

Figure 7:
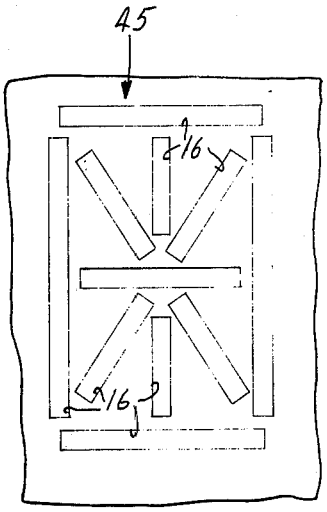
FIG. 7 is a schematic representation of an 11 segment shutter array for forming alphabetic and numeric characters.

The sign face structure 10 is also adaptable to characters other than numbers. The matrices 17—17 can of course be used to form alphabetic characters. More distinct alphabetic characters, as well as numeric characters, are provided by an 11segment matrix 45 shown in FIG. 7. The invention is not limited to numeric and alphabetic characters, however, for knowledge of the present invention will enable those skilled in the art to devise other symbols as well. Those skilled in the art will also device constructions other than those illustrated. For example, the handle 22 (FIG. 3) may be formed integrally with the shutter 19, thus eliminating the need for slot 30 and plate 14. Also, in some applications, friction between the track or brackets and the shutters may be used to retain the shutters in the open and closed positions and thereby obviate the need for magnets.

Having thus described the preferred and alternative embodiments of the sign face structure of the present invention, what is claimed is:

1. A sign structure having changeable characters, comprising:

a plate having a patterned array of rectangular openings, said plate having front and rear surfaces, the front surface being a predetermined color;

shutters having opposite surface portions, one surface portion being the same color as the front surface of said plate and the opposite surface portion being a contrasting color, each of said shutters being rotatably mounted in one of said openings for movement between a first position presenting the one surface portion to said opening and a second position presenting the opposite surface portion to said opening; and handle means for securing the shutters in the first or second position, said handle means comprising:

a magnetizable handle plate and flange integral with and extending from said shutter; and a magnet disposed on opposite sides of each of said shutters proximate thereto for magnetically attracting said handle to retain said shutter and handle in said first or second positions.

2. A sign structure comprising:

(a) a plate having a patterned array of rectangular openings, the plate having front and rear surfaces, the front surface being of a predetermined color, (b) a series of shutters, each shutter disposed in one of said openings and each having a first face in a color matching the color of the front surface of the plate and a second face in a color contrasting with the color of said front surface, each shutter mounted for rotation within the openings for rotatable movement from a first position to a second position and vice versa, the first face of said shutter being in a plane spaced from and parallel to the front surface of said plate when the shutter is in said first position and the second face of the shutter being in said plane when the shutter is in said second position, (c) a pair of magnets associated with each opening and mounted on one surface of said plate, one magnet at each side of each of said openings and proximate to the shutter rotatably mounted therein, and (d) a handle integral with one side of each of said shutters consisting of a handle plate and a flange for rotating said shutter from said first to second position and vice versa, the handle plate of said handle being in magnetic contact with one of said magnets when the shutter is in said first or second position to retain said shutter and handle in said position.

* * * * *